US007621100B2

(12) United States Patent
Kufner et al.

(10) Patent No.: US 7,621,100 B2
(45) Date of Patent: Nov. 24, 2009

(54) TILE ALIGNMENT AND LEVELING DEVICE AND METHOD FOR USING THE SAME

(75) Inventors: Edward A. Kufner, Fairfield, IA (US); Michele Volponi, Hamilton, IL (US)

(73) Assignee: DaVinci Italia/USA Group, LLC, Fairfield, IA (US)

( * ) Notice: Subject to any disclaimer, the term of this patent is extended or adjusted under 35 U.S.C. 154(b) by 445 days.

(21) Appl. No.: 10/906,478

(22) Filed: Feb. 22, 2005

(65) Prior Publication Data

US 2006/0185319 A1 Aug. 24, 2006

(51) Int. Cl.
*E04F 21/18* (2006.01)

(52) U.S. Cl. ..... 52/749.11; 52/747.11; 52/126.7; 33/526

(58) Field of Classification Search ..... 52/111, 52/125.4, 126.1, 126.7, 127.1, 127.12, 749.11, 52/747.11, DIG. 1; 33/526, 527, 613, 645, 33/533

See application file for complete search history.

(56) References Cited

U.S. PATENT DOCUMENTS 3,511,001 A * 5/1970 Morgan ..... 52/126.5
4,397,124 A * 8/1983 Redman ..... 52/126.4
4,397,125 A 8/1983 Gussler, Jr.
4,558,544 A * 12/1985 Albrecht et al. ..... 52/126.6
5,000,890 A 3/1991 DiStefano et al.
5,263,260 A 11/1993 Smith
5,288,534 A * 2/1994 Tavshanjian ..... 428/64.1
5,603,195 A * 2/1997 Cosentino ..... 52/749.11
5,607,256 A 3/1997 McCleary
5,675,942 A * 10/1997 Crawford ..... 52/127.3
5,832,619 A 11/1998 Volkema, Jr.
5,966,781 A * 10/1999 Geiger ..... 24/16 PB
6,000,184 A 12/1999 Fernandes
6,412,185 B1 7/2002 Mills et al.
6,625,951 B1 * 9/2003 McCarthy ..... 52/747.1
6,704,972 B2 * 3/2004 Pyle ..... 24/16 PB

OTHER PUBLICATIONS

Southwest Equipment Management, Inc., Tile Eze, Marble-Plane promotional literature.

* cited by examiner

*Primary Examiner*—Brian E Glessner
*Assistant Examiner*—James J Buckle, Jr.
(74) *Attorney, Agent, or Firm*—Ryan N. Carter

(57) ABSTRACT

A device for aligning and leveling tiles as they are laid in floors, walls, countertops, or the like. The device has a top plate with several spacer fins and a bottom plate. The plates are combined with a shaft that extends from the bottom plate through the top plate so that the top plate is movable along the length of the shaft.

1 Claim, 7 Drawing Sheets

TILE ALIGNMENT AND LEVELING DEVICE AND METHOD FOR USING THE SAME

BACKGROUND OF THE INVENTION

This invention is directed to the field of laying and leveling tile and slabs. More particularly, the invention is directed to a device for aligning and leveling adjacent tiles as they are laid in floors, walls, countertops, or the like.

Tile has become a popular decorative and functional article for use in floors, walls, countertops, and the like. Both professional tile installers and do-it-yourselfers spend a great deal of time aligning and leveling tiles as they are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons for properly laying tile, a level surface is essential in tile floors so that people do not trip and fall on unevenly laid tiles. Replacing or otherwise correcting errors in tile installation takes time that adds to the total cost of the tile installation.

Laying and leveling tile can be difficult because many substrates are uneven, such as the ground substrate when laying tile for an outdoor patio. In this case, it can be difficult to raise the low areas or the substrate with mortar or other objects so that all the tiles are level. Further, tiles can shift and sink into mortar as the mortar dries. It is therefore necessary to continually monitor newly laid tiles as the mortar dries to ensure that they remain level. If some of the tiles begin to sink into the mortar, it can be difficult to raise the sinking tiles without disturbing the adjacent tiles.

Tile installers have used a variety of methods to maintain quality tile installation while completing the installation process as fast as possible. One basic method uses markings on the substrate surface. Marking the installation surface requires the mortar to be carefully applied such that the marks remain visible. Although this technique aids in the alignment of the tiles, it does not keep the tiles level as they are laid in the mortar. Further, the use of this marking technique increases the amount of time required for the installation which results in increased cost.

Another device used for laying and leveling tile is a frame designed to space tiles an appropriate distance. This type of frame is typically a fixed grid which is designed for a specific tile size. The disadvantage of this type of device is that it is a fixed size which requires a professional installer to carry multiple frames in order to be capable of installing any tile size. A further disadvantage of this type of frame is that it is only capable of installing one type of tile at a time.

Another device used to lay and align adjacent tiles is a spacer such as the one described in U.S. Pat. No. 6,625,951 (McCarthy). The spacer disclosed in this patent provides a square edge for properly aligning adjacent tiles at right angles, and a height adjustment means for adjusting the height of the tiles relative to the mortar surface. One problem with this device is that it is difficult to set multiple devices to the same height which often results in an uneven tile surface. A related problem with this device is that the adjustment means does not allow the height of the tiles to be adjusted after the tile is laid because the height adjustment means is located under the tile after the tile is laid.

Therefore, there is a need for an efficient and inexpensive tile leveling and alignment device that allows for the vertical adjustment of tiles relative to each other after the tiles have been laid in the mortar.

SUMMARY OF THE INVENTION

The present invention is directed to a tile leveling and alignment device for use in installing tiles on substrates such as floors, walls, countertops, or the like. The present invention comprises a top plate and a bottom plate. The plates are combined with a shaft that extends from the bottom plate through the top plate so that the top plate is movable along the length of the shaft. A typical first step in laying tile is the application of a setting bed, such as a cement or mortar compound, to the substrate surface. Thereafter, the tiles can be placed in the setting bed. The bottom plate of the device is positioned in the setting bed beneath the tiles so that the shaft extends upward between adjacent tiles. The bottom plate is preferably positioned so that it contacts multiple tiles. The shaft extends from the bottom plate upward between adjacent tiles and is combined with the top plate, which is located above the tiles. The top plate is movably mounted on the shaft so that after the tiles are laid in the setting bed and on top of the bottom plate, the top plate is moved toward the tiles until the tiles are in contact with both plates. The plates cradle the tiles and can move vertically along the shaft so that adjacent tiles are leveled relative to themselves without regard to whether the substrate material is level. The plates hold the tiles at the same height so that corners and/or edges of the adjacent tiles remain level in the setting bed as the setting bed dries and cures.

After the setting bed dries, thereby securing the tiles to the substrate, the shaft is separated from the bottom plate leaving the bottom plate beneath the set tiles. The top plate and the portion of the shaft above the separation point are released from the set tiles allowing the top plate to be reused in subsequent tile setting and leveling procedures.

In addition to the tile leveling feature described above, the preferred embodiment also comprises a tile spacer means for aligning adjacent tiles. The tile spacer means is comprised of one or more vertical fins extending from the surface of the plates toward the tiles, i.e. the fins are on the lower surface of the top plate and/or the upper surface of the bottom plate. The fins are adapted to be placed between adjacent tiles so that adjacent tiles in communication with the fins are properly aligned.

A plurality of devices of the present invention can be simultaneously used between numerous tiles being laid on a substrate so that all the tiles on the substrate are level and aligned relative to each other.

DESCRIPTION OF THE PREFERRED EMBODIMENT OF THE INVENTION

The present invention is a tile alignment and leveling device. The device of the present invention can be used to align and level tiles that are being secured to any suitable substrate, including floors, walls, and countertops. It should be noted that all words used in this specification such as upper, lower, top, and bottom, are relative to the device as it would sit on a floor with the top plate 10 above the bottom plate 12.

Figure 1:
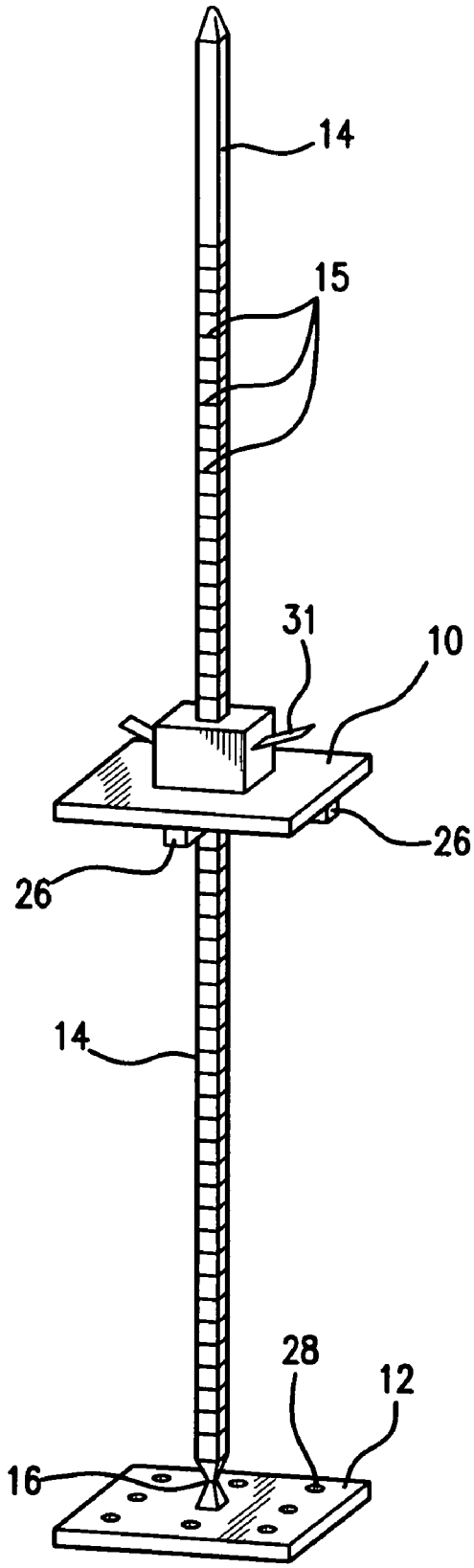
FIG. 1 is a perspective view of the device of the present invention.

As best seen in FIG. 1, the present invention comprises a top plate 10 and a bottom plate 12 combined with a shaft 14. The plates 10, 12 can be made from any suitable material, however, they are preferably comprised of plastic with a metal reinforcing plate embedded inside the plastic. The metal insert provides the strength that is needed for leveling heavy tiles 18 or slabs, while the outer plastic portion does not damage the tile 18 and does not rust.

Figure 4:
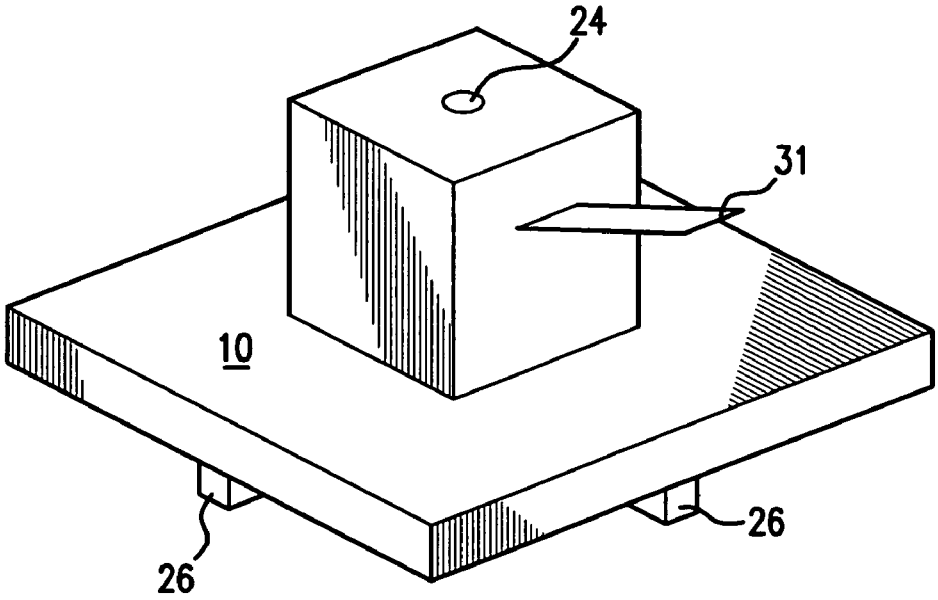
FIG. 4 is a perspective view of the upper side of the top plate.
Figure 5:
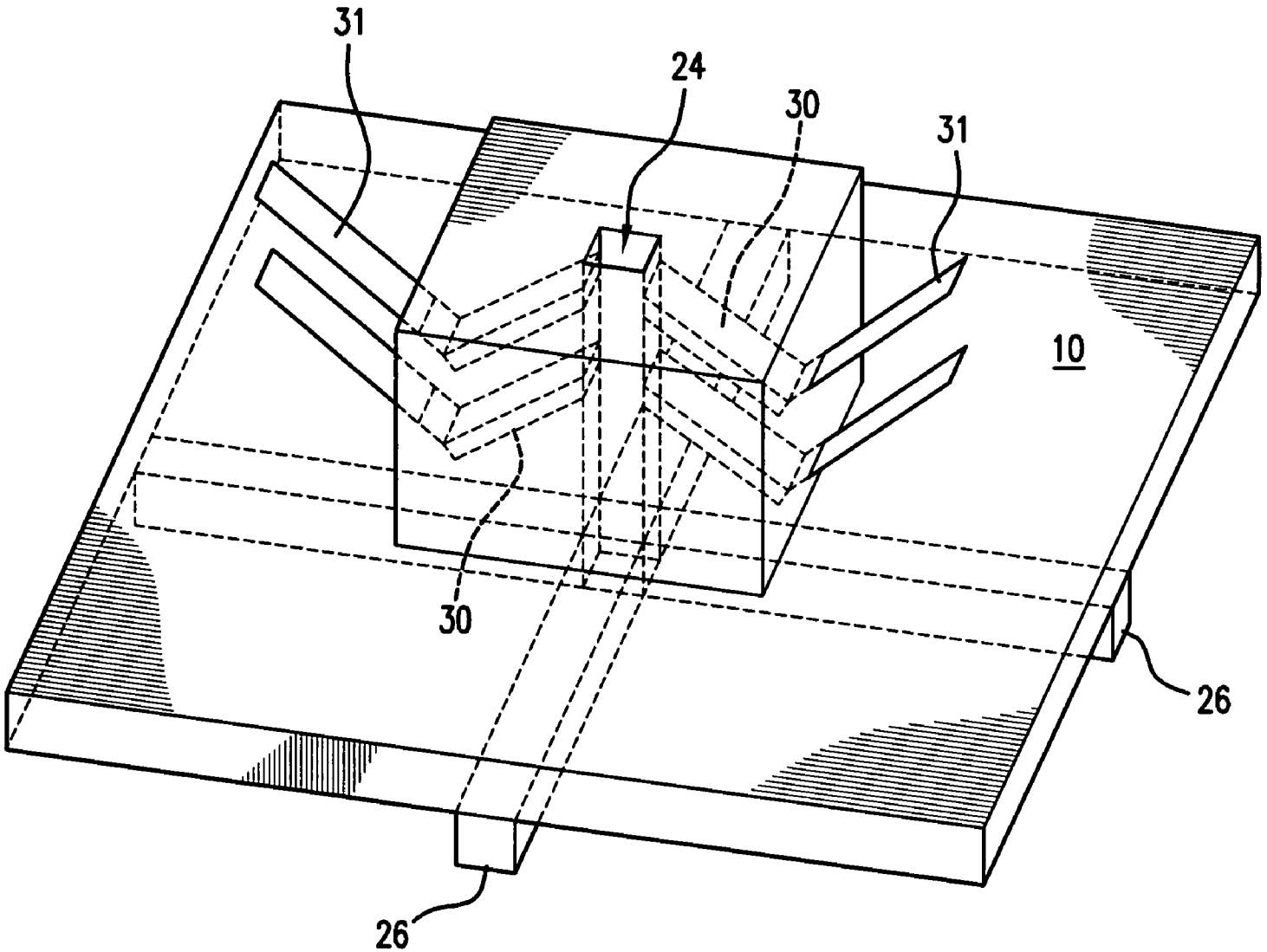
FIG. 5 is a perspective cut away view of the upper side of the top plate showing the locking tongues and tongue release.

FIGS. 4 and 5 show that the top plate 10 comprises an opening referred to as a sliding channel 24 which is adapted to receive the shaft 14. The top plate 10 is movable along the length of the shaft 14 through the sliding channel 24. The shaft 14 is preferably comprised of plastic, thereby making the shaft 14 semi-rigid. In the preferred embodiment, the shaft 14 is generally square with surface features 15 on all four of its sides, however, the shaft 14 can be any shape including round and rectangular. The surface features 15 are further described below. The square shape allows the top plate 10 to be combined with the shaft 14 in any of four directions as long as the fins 26 are properly aligned with respect to the tiles 18. This increases efficiency because the user does not spend time determining the directionality of the top plate 10 relative to the shaft 14 when the top plate 10 is threaded onto the shaft 14. In alternate embodiments, the shaft 14 has surface features 15 on only one or two of its sides.

Figure 2:
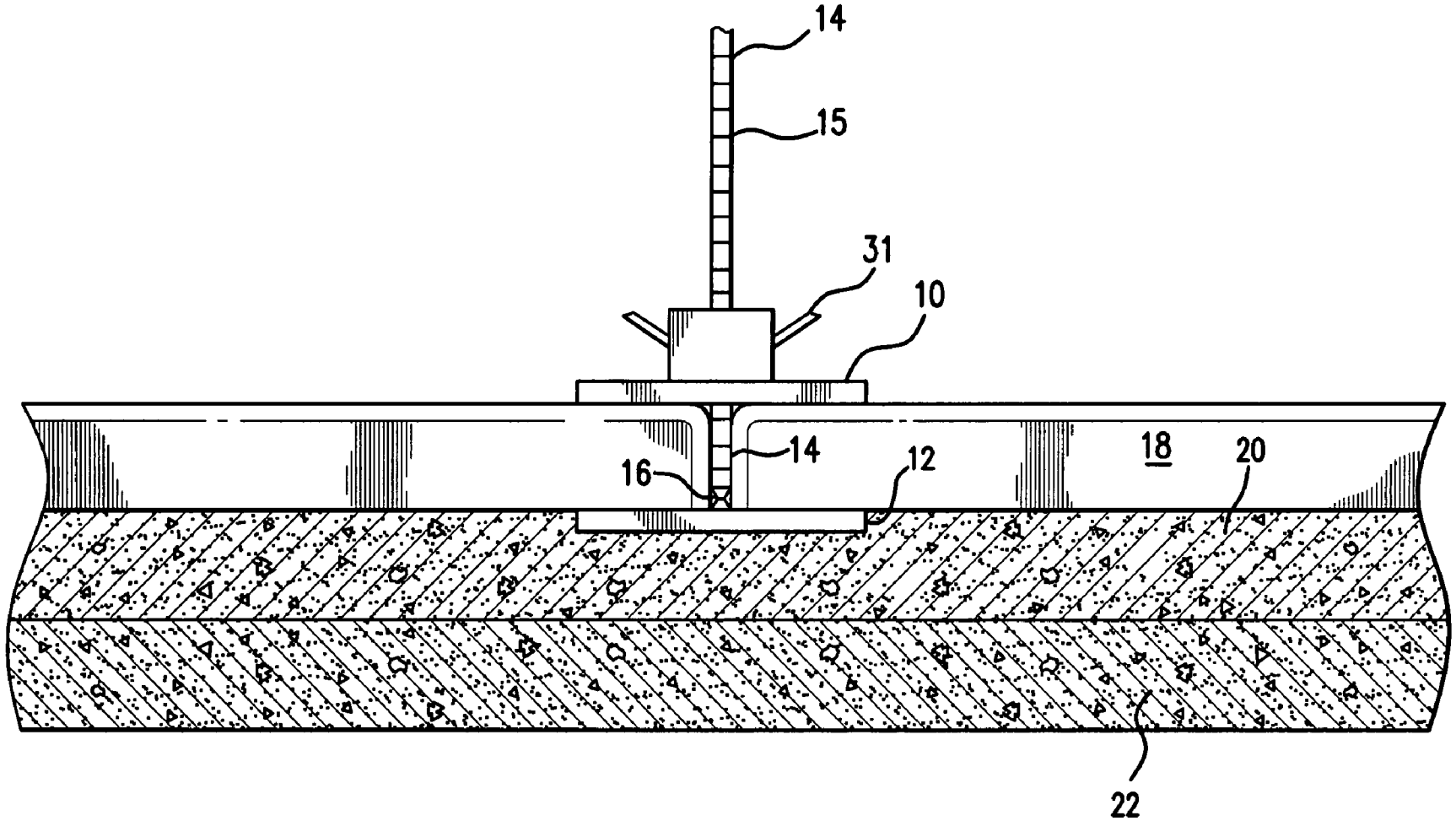
FIG. 2 is an elevational view of the device of the present invention.

FIG. 2 is a side elevational view showing the device of the present invention between adjacent tiles 18. A typical first step in laying tile 18 is to apply a setting bed 20 such as mortar or cement to the substrate surface 22. After the setting bed 20 is applied, the tiles 18 can be placed in the setting bed 20. The bottom plate 12 of the device is positioned in the setting bed 20 beneath the tiles 18 so that the shaft 14 extends upward between adjacent tiles 18, preferably at joint or corner locations. The shaft 14 extends from the bottom plate 12 upward between the tiles 18 and is combined with the top plate 10, which is positioned above the tiles 18. The top plate 12 is moved toward the tiles 18 until the tiles 18 are in contact with both plates 10, 12 as shown in FIG. 2. The plates 10, 12 cradle the tiles 18 and can move vertically along the shaft 14 so that adjacent tiles 18 are level relative to themselves without regard to whether the substrate material 22 is level. The plates 10, 12 hold the tiles 18 at the same height so that corners and/or edges of the adjacent tiles 18 remain aligned and level in the setting bed 20.

It is important that the top plate 10 does not move upward along the shaft 14 as the plates 10, 12 are holding the tiles 18 in place. To hold the top plate 10 at its desired position on the shaft 14, the shaft 14 and locking tongue 30 function similarly to a commercially available "zip tie" in that the top plate 10 can move freely in a first direction (downward) along the length of the shaft 14, but cannot move freely in a second direction (upward) that is opposite to the first direction. As seen in FIG. 1, the shaft 14 has a plurality of surface features 15 along its length. These surface features 15 can be either indentations or elevated ridges. The locking tongue(s) 30 of the top plate 10, shown in FIG. 5, are angled and adapted to interfere with the surface features 15 to allow movement of the shaft 14 in only one direction. The surface features 15 are preferably close enough together so as to provide a nearly infinite adjustment for the height of the top plate 10. Infinite adjustment type zip ties are known in the art. In one embodiment shown in FIG. 5, the locking tongues 30 have tongue releases 31. Activation of the tongue release 31 enables the user to release the locking tongues 30 from the surface features 15 on the shaft 14 and thereafter allow movement of the top plate 10 in the second (upward) direction.

One of ordinary skill in the art will realize that the number of locking tongues 30 can vary depending on the shape of the shaft 14 and the desired holding strength of the device. For example, four locking tongues 30 may be positioned on the top plate 10 so that there is one tongue 30 on four different sides. This arrangement is preferably for use with a square shaft 14 having surface features 15 on all four sides. Alternatively, as shown in FIG. 5, there may be more than one locking tongue 30 per side.

Figure 3:
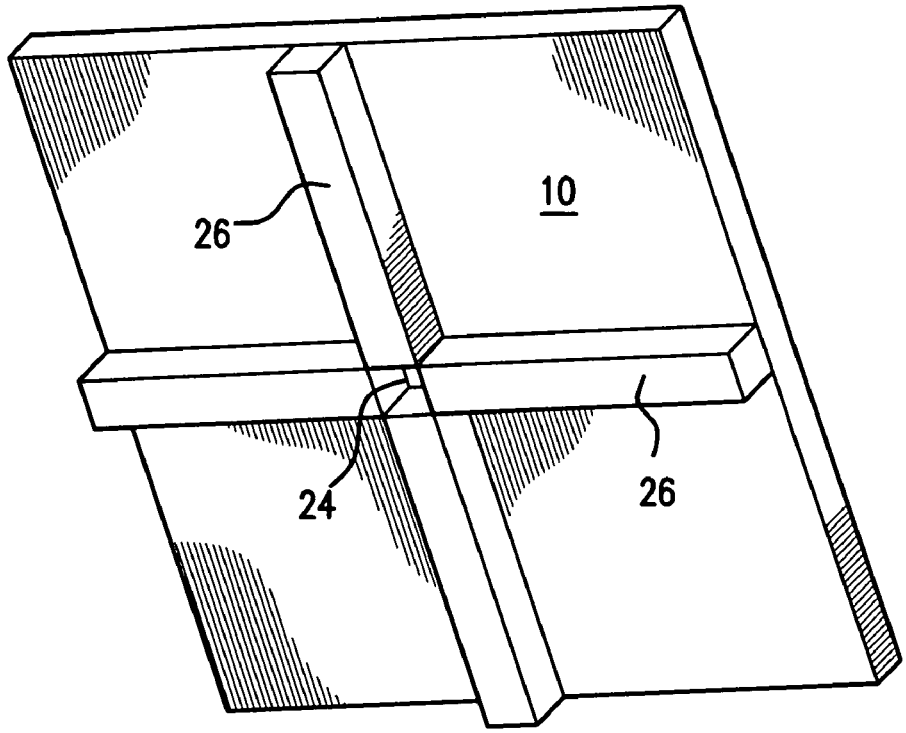
FIG. 3 is a perspective view of the lower side of the top plate showing the spacer walls.

As best seen in FIG. 3, the lower side of the top plate 10 comprises several spacer fins 26. The spacer fins 26 are preferably rectangular shaped and extend from the edge of the plate 10 toward the center of the plate 10. In the preferred embodiment, four spacer fins 26 are used at the intersection of four tiles 18, and two spacer fins 26 on either side of the sliding channel 24 are used at the intersection of two tiles 18. Further, it is preferred that the spacer fins 26 extend from the edge of the plate 10 to the edge of the sliding channel 24 to reduce the opportunity for mud or mortar to seep through the channel 24. The thickness of the spacer fins 26 may vary depending on the desired distance between adjacent tiles 18. In an alternate embodiment, there are spacer fins 26 facing upward from the upper portion of the bottom plate 12 which serve the same function as the above described spacer fins 26.

The bottom plate 12 comprises a plurality of openings 28. The openings 28 allow the setting bed material 20 to seep through the bottom plate 12. This seepage allows the setting bed material 20 to bond with the portion of the tile 18 directly above the bottom plate 12, which otherwise would not contact the setting bed material 20. Further, the seepage helps to ensure that the tiles 18 remain level as forces are applied to the plates 10, 12 and/or tiles 18 during tightening, leveling, and setting. If the setting bed material 20 was not allowed to seep through the bottom plate 12, the setting bed material 20 could raise the bottom plate 12 as it dried which would consequently affect the level of the tiles 18.

After the setting bed 20 dries, and the tiles 18 are secured to the substrate 22, the user removes the portion of the device that is visible above the laid tiles 18. As seen in FIGS. 1 and 2, the shaft 14 comprises a separation point 16 near the connection of the shaft 14 and the bottom plate 12. In the preferred embodiment, the separation point 16 is structurally weaker than the remainder of the shaft 14 so that the user can twist the shaft 14 above the tiles 18 and cause the shaft 14 to break at the separation point 16. Although the separation point 16 is capable of breaking when twisted, it is strong enough so that when force is applied longitudinally along the length of the shaft 14, the shaft 14 does not break. Once separated at the separation point 16, the bottom plate 12 remains below the tiles and is therefore not reusable. The top plate 10, however, can be removed from the shaft 14 and reused in subsequent tile 18 laying. As discussed above, the shaft 14 is preferably made of a semi-rigid plastic, and is preferably square in shape. This preferred square shape and semi-rigid material allow the shaft 14 to more easily be broken at its separation point 16.

Figure 6:
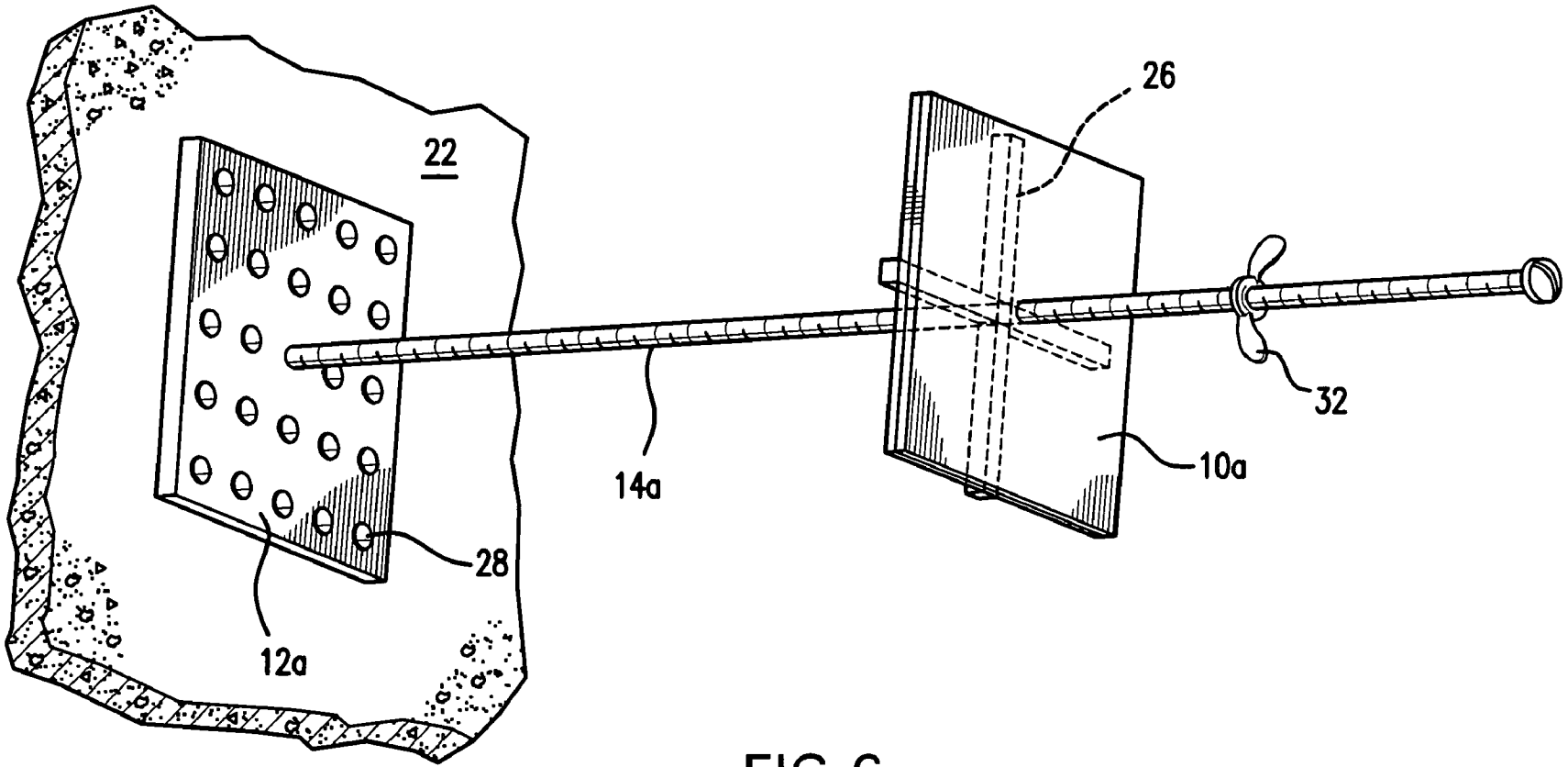
FIG. 6 is a perspective view of the wall-tile embodiment.

FIG. 6 shows an alternate embodiment preferably for use in laying tiles 18 in wall substrates 22. This embodiment also comprises a top plate 10*a* and a bottom plate 12*a* combined by a shaft 14*a*. In this embodiment, the top plate 10*a* is preferably metal with a plastic or rubber material on the bottom surface of the plate 10*a*. The shaft 14*a* in this embodiment is preferably threaded like a screw. The bottom plate 12*a* comprises a threaded opening into which the shaft 14*a* is screwed for securing the shaft 14*a* to the bottom plate 12*a*. Preferably, the opening in the bottom plate 12*a* is reverse threaded so that the shaft 14*a* does not become unscrewed from the bottom plate 12*a* as the nut 32 us tightened. Further, preferably, the opening in the bottom plate 12*a* only extends through a portion of the bottom plate 12*a* (not all the way through) so that the shaft 14*a* is secured to the bottom plate 12*a*, but does not screw into the substrate 22 beneath the plate 12*a*.

The top plate 10*a* is movable along the length of the shaft 14*a*. A nut 32, preferably a wing nut, is threaded onto the shaft 14*a*. The plates 10*a*, 12*a* are placed on either side of the tiles 18 as described in the previous embodiment, and then the nut 32 is tightened down the shaft 14*a* to hold the two plates 10*a*, 12*a* snugly on either side of the tile 18. After the tiles 18 are set in the setting bed 20, the screw/shaft 14*a* can be unscrewed from the bottom plate 12*a*. This allows the top plate 10 and screw/shaft 14*a* to be removed from the tile, while the bottom plate 12*a* remains underneath the set tile 18. Alternatively, the screw/shaft 14*a* can be separated from the bottom plate 12*a* by using a weak separation point 16 as described in the first embodiment.

Figure 7:
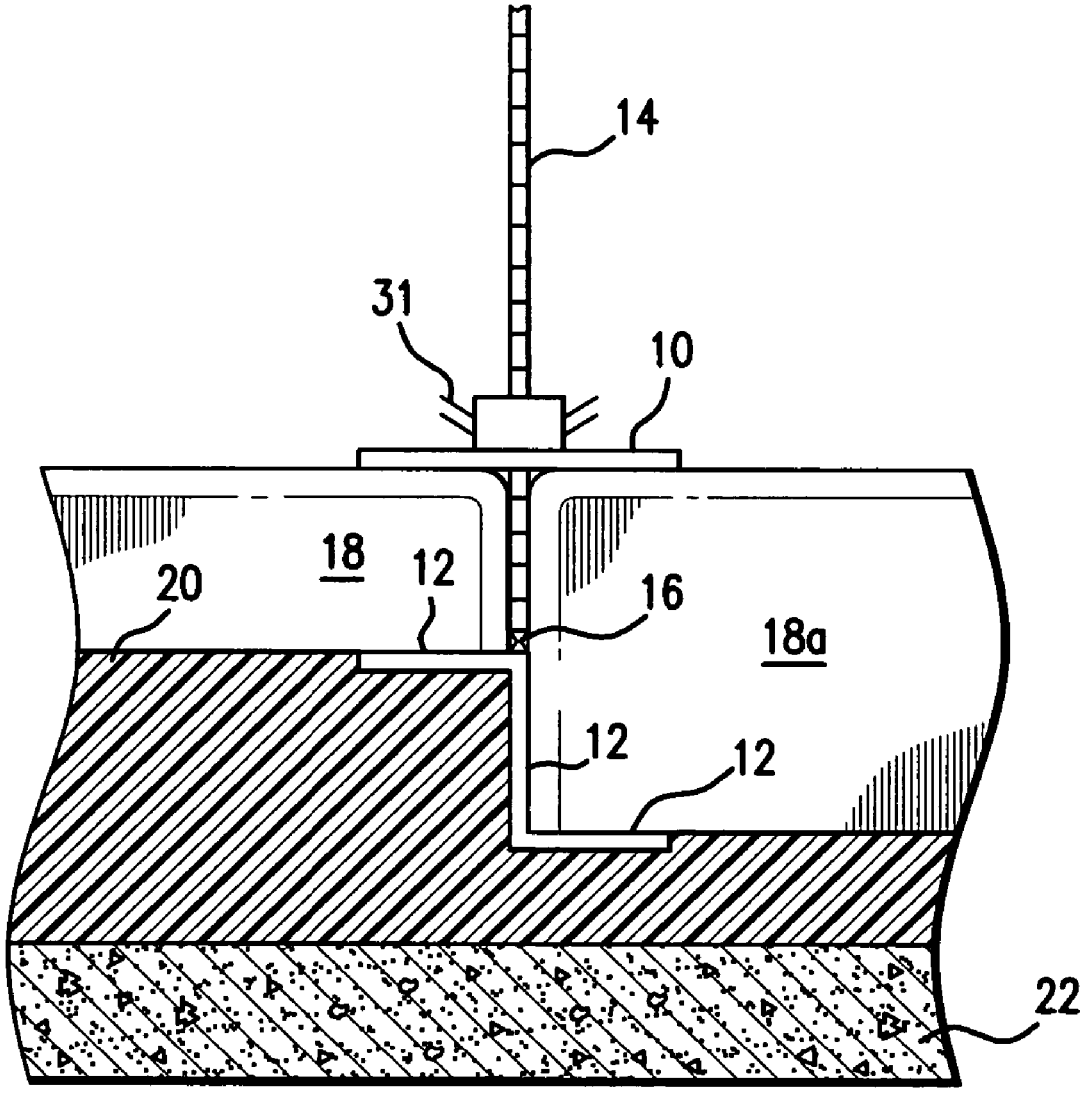
FIG. 7 is an elevational view of the duel height bottom plate embodiment.

FIG. 7 shows an alternate embodiment that can be used with any of the above embodiments. In this embodiment, the bottom plate 12 is shaped like two stairs in that there are two horizontal portions combined by a vertical portion. The top of the vertical portion is preferably where the bottom plate 12 is combined with the shaft 14. The purpose of this embodiment is so that the device can be used to lay and level two tiles 18, 18*a* of different thickness. This is shown in FIG. 7 wherein the device is being used to combine tile 18 which is not as thick as tile 18*a*.

Figure 8:
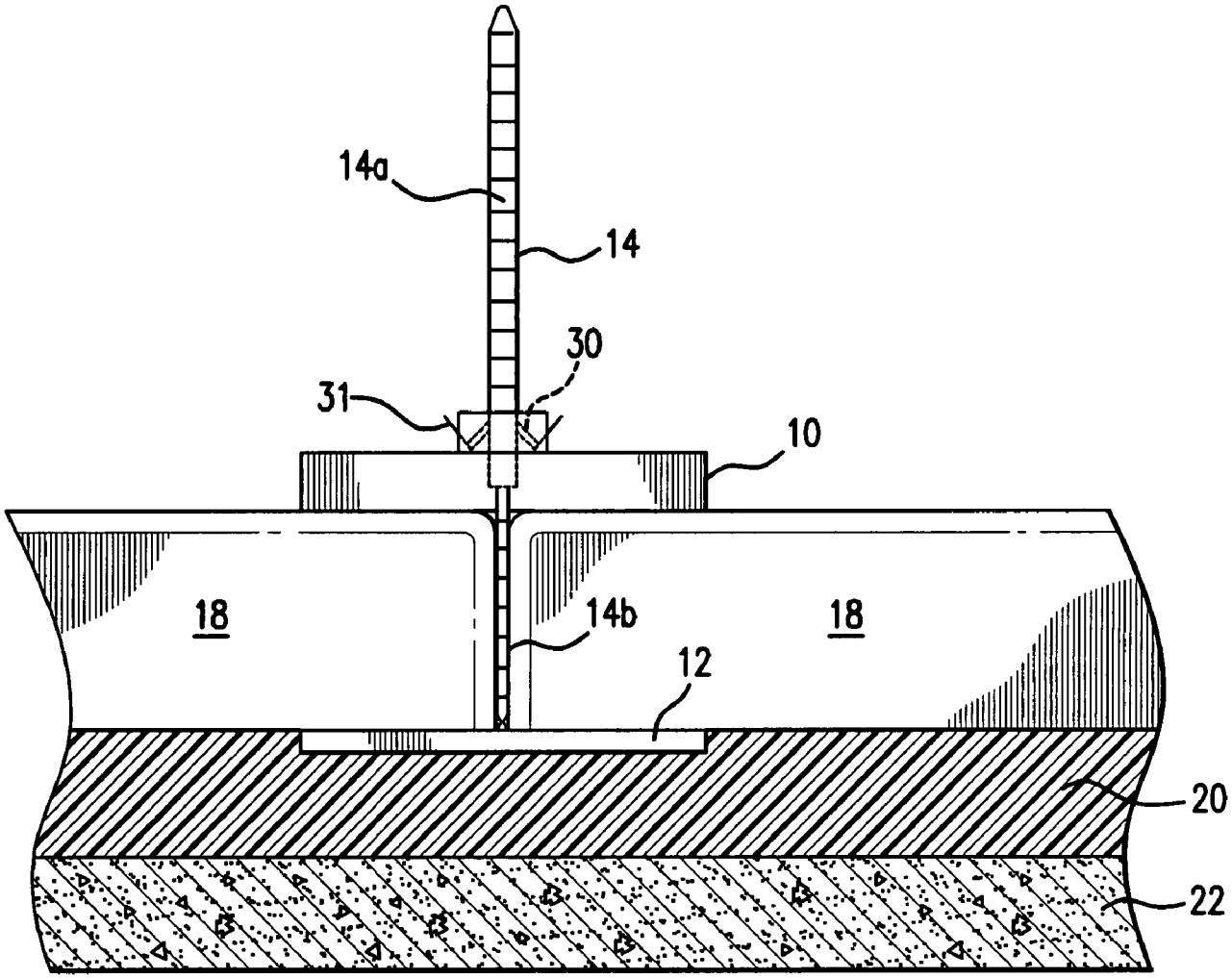
FIG. 8 is an elevational view showing an embodiment wherein the top portion of the shaft is thicker than the bottom portion of the shaft.

FIG. 8 shows an alternate embodiment which can be used with any of the above embodiments wherein the upper portion 14*a* of the shaft 14 is thicker than the lower portion 14*b* of the shaft 14. The upper portion 14*a* of the shaft 14 is thicker so that the user can better grip the shaft 14 when tightening the top plate 10 against the tiles 18. The lower portion 14*b* of the shaft 14 that extends between adjacent tiles toward the bottom plate 12 is thinner so that tiles 18 can be placed closer together, if desired, and so that it is easier to separate the shaft 14 from the bottom plate 12 in the embodiment comprising the separation point 16.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A device for laying and leveling tiles, said device comprising:

a shaft having an upper portion and a lower portion;

a bottom plate combined with the shaft lower portion;

a top plate having an opening which is adapted to receive the shaft, said top plate having an upper side and a lower side, the lower side of the top plate having two spacer fins adapted for insertion between adjacent tiles; and a locking assembly having an opening adapted to receive the shaft;

wherein the bottom plate comprises a first generally flat portion extending from the shaft in a first direction and a second generally flat portion extending from the shaft in a second direction, wherein the first generally flat portion is combined with the shaft at a first location in a first plane and the second generally flat portion is combined with the shaft at a second location in a second plane that is parallel to the first plane so that the two planes are separated a predetermined distance from each other along the length of the shaft to allow the device to be used between tiles of different thicknesses.

* * * * *

UNITED STATES PATENT AND TRADEMARK OFFICE

CERTIFICATE OF CORRECTION

PATENT NO. : 7,621,100 B2
APPLICATION NO. : 10/906478
DATED : November 24, 2009
INVENTOR(S) : Kufner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 955 days.

Signed and Sealed this

Twenty-sixth Day of October, 2010

David J. Kappos

David J. Kappos
*Director of the United States Patent and Trademark Office*